United States Patent [19]

Suling et al.

[11] 4,337,866

[45] Jul. 6, 1982

[54] MAIL SORTING APPARATUS AND SYSTEM

[75] Inventors: Robert C. Suling, Crozet; Charles W. Tomlinson, Orange; Winfred G. Fields, Waynesboro, all of Va.

[73] Assignee: Acme Visible Records, Inc., Crozet, Va.

[21] Appl. No.: 172,652

[22] Filed: Jul. 28, 1980

[51] Int. Cl.[3] ..... B07C 9/00; B07C 7/04

[52] U.S. Cl. ..... 209/656; 209/705; 209/900; 209/933; 209/942; 211/10; 211/72; 248/95; 414/134; 271/279

[58] Field of Search ..... 209/705, 900, 656, 933, 209/551, 942; 211/10, 12, 46, 47, 72; 206/425; 248/95, 99; 414/134; 198/367, 370, 372; 271/279

[56] References Cited

U.S. PATENT DOCUMENTS

| | | | |
|---|---|---|---|
| 1,204,428 | 11/1916 | Grandfield . | |
| 1,219,067 | 3/1917 | Bailey et al. . | |
| 1,332,356 | 3/1920 | Olson . | |
| 1,851,958 | 3/1932 | Hill . | |
| 2,697,514 | 12/1954 | Stahl | 209/933 X |
| 3,497,073 | 2/1970 | Bartell . | |
| 3,757,939 | 9/1973 | Henig | 414/134 X |
| 3,782,541 | 1/1974 | Wood | 209/933 X |
| 3,837,484 | 9/1974 | Ruckebier | 414/134 |
| 4,008,813 | 2/1977 | Leersnijder | 414/134 X |
| 4,168,004 | 9/1979 | Owen | 209/705X |

*Primary Examiner*—Allen N. Knowles
*Attorney, Agent, or Firm*—Pennie & Edmonds

[57] ABSTRACT

A system for routing correspondence from a first location including a plurality of slot entries to a predetermined conveyor path to a second, discharge location. A collection assembly is disposed at the discharge location for collection of routed correspondence along two adjacent conveyor paths.

10 Claims, 7 Drawing Figures

110
74
52
50
120
116
118
96
106
104
108
102
112
62
80
98
78
96
102
66
70
118
104
106
110
40
114
42
72
46
44
58
82
112
20

104
78
46
84
58
44
66
50
70
62
112
98
106
110
86
114
72
54
20
42
110
86
64
48
68
112
106
104
76
84
56
D
60
114

MAIL SORTING APPARATUS AND SYSTEM

TECHNICAL FIELD

The invention relates to a routing system including a depository for both mail, a sorting station including a plurality of entry ways to individual distribution channels through which sorted mail is routed to a discharge location, and an assembly at the discharge location for collection of the routed mail. The invention, also, relates to the collection assembly for use in the routing system.

BACKGROUND ART

The sorting and routing of mail which may include mail from sources outside private and/or governmental installations received from the postal service and internal correspondence (hereinafter, collectively, "correspondence") to the proper addressee or location has posed a problem which becomes increasingly acute as that installation increases in size. Typically, correspondence is received at a single location, at which the function of sorting and routing is carried out to locate each individual piece of correspondence to a bag, pouch or other form of receptacle. The manner by which the individual pieces of correspondence are sorted and routed for delivery to the addressee or location may include operations calling for total manual capability, both manual and automatic capability, and a total automatic capability. For example, in U.S. Pat. No. 1,322,356 to Samuel Olsen, correspondence may be located manually to any one of several pockets in a desk at one location to be retained at least temporarily or to move automatically from the pocket through a chute to a conveyor and, finally to a downstream location. U.S. Pat. No. 1,219,067 to Charles H. H. Bailey et al discloses apparatus comprising a plurality of chutes, each chute having a plurality of individual routing channels, communicating a sorting location and a location to which respective correspondence is to be routed. U.S. Pat. No. 1,851,958 to Robert Hill discloses an apparatus substantially similar in operation to that of Bailey and Olsen.

Each of the aforementioned patents, while they disclose a form of routing system, all suffer from a problem of collection of correspondence at a discharge location. To this end, none of the prior art systems disclose the use of a collection device which may be readily located to a position below a pair of conveyor paths, or a device having convertible capability of use in the support either of a box or one or a pair of bags for collection of correspondence from each conveyor path.

SUMMARY OF THE DISCLOSURE

The invention relates to routing apparatus for correspondence wherein the apparatus includes a housing and plurality of slots for entry of correspondence at an upstream point in a selected conveyor path. The correspondence thus, moves along each conveyor path to a discharge at a downstream location. A rack assembly for collection of correspondence is positioned at the discharge location and in position to collect correspondence from each of two adjacent conveyor paths. The rack assembly comprising a hanger assembly including a frame, the latter of which has a plurality of members arranged in a rectangular pattern. Each of the members is in the form of a substantially rectangular plate and each plate is connected to an adjacent plate along the side of minor dimension. A collection device for collecting correspondence from the paths is supported by the hanger assembly. The collection device provides an opening located to receive correspondence from either or both of the conveyor paths. The apparatus also includes structure for supporting the hanger assembly below said discharge location of each of the conveyor paths.

The rack assembly for use with conveying apparatus comprises the hanger assembly heretofore described and at least one hanger member having a base and a pair of arms. One of the arms of the hanger is supported by one frame member and the other of the arms of the hanger is supported by another frame member of an opposed pair of frame members so that the base of the hanger extends between the opposed pair of frame members. The hanger is mounted for movement pivotally from a first to a second position and stop means serve to locate the hanger in each position. A collection device which may be a box or a bag is supported by the hanger assembly as heretofore mentioned.

In a preferred embodiment, a second hanger member is similarly located and similarly movable from the first position, a position wherein each base is juxtaposed to an adjacent frame member of the other opposed pair of frame members, to a second position wherein the bases of the hangers are juxtaposed to one another.

In the event that the collection device includes a box, the hanger members are located to the first position. In the event that the collection device includes two bags, each said hanger member is located to the second position so that each bag is supported partially by the hanger member and partially by the hanger assembly. A single bag may be supported by the hanger assembly with the hanger members in the first position.

As an additional aspect of the invention, the hanger assembly may be mounted for movement relative to the supporting structure and the conveying paths.

BEST MODE FOR CARRYING OUT THE INVENTION

As previously indicated, at least in larger facilities, correspondence, including mail and internal correspondence to be sorted and routed to a proper addressee or location, typically is brought to a collection location (see FIG. 1) represented by a table 10. The table either is mounted for rotation or mounted stationarily by conventional structure, and preferably a working zone (not shown) for a single individual or for several individuals will be located adjacent the table, in easy reach of the correspondence thereon. A console 12 is located adjacent the table. The console includes a plurality of slots 14, $\mathbf{14}_1$, $\mathbf{14}_2$, . . . $\mathbf{14}_n$ with each slot, as will be described, providing an entry to a respective one of a plurality of conveying paths along which correspondence is conveyed to a discharge location.

Figure 1:
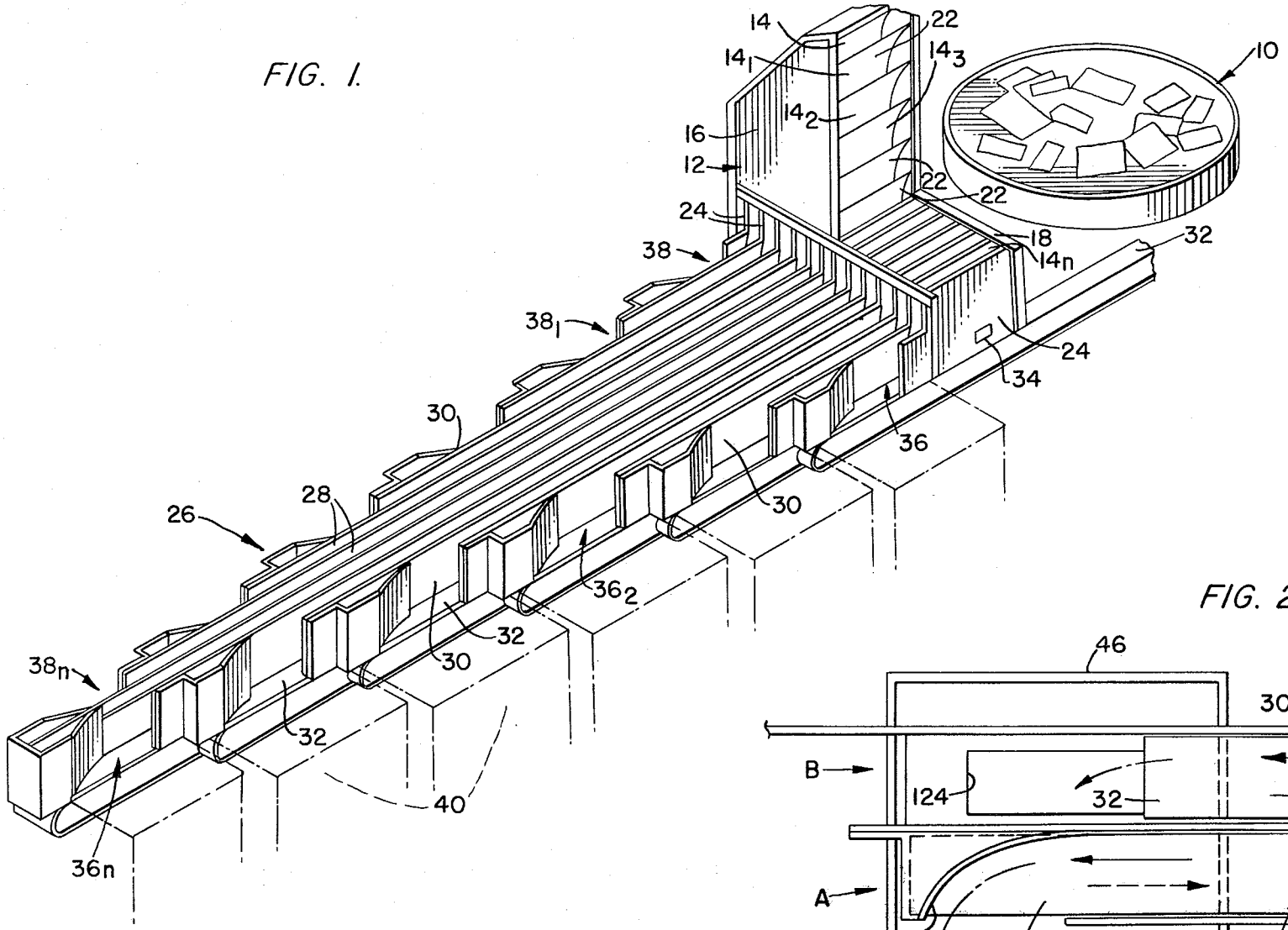
FIG. 1 illustrates the environment of the invention in mail sorting apparatus and system in perspective view.
Figure 4:
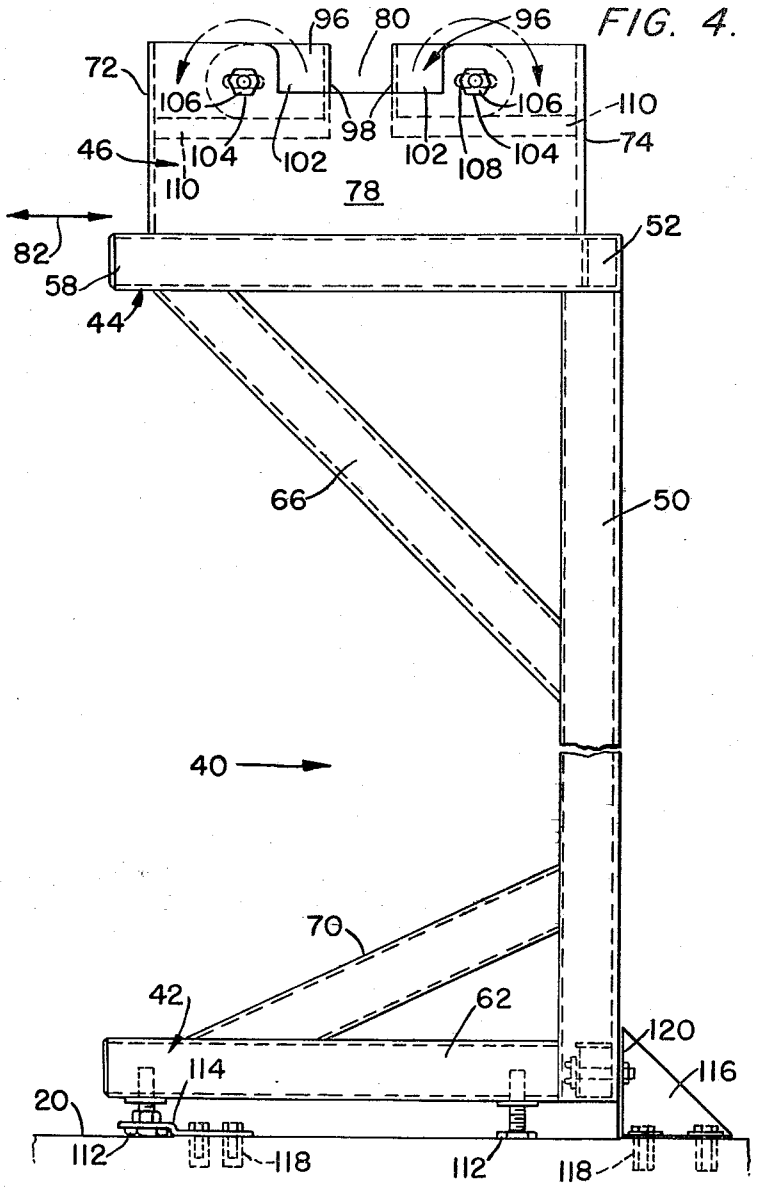
FIG. 4 is a side elevation of the rack assembly of FIG. 3.
Figure 3:
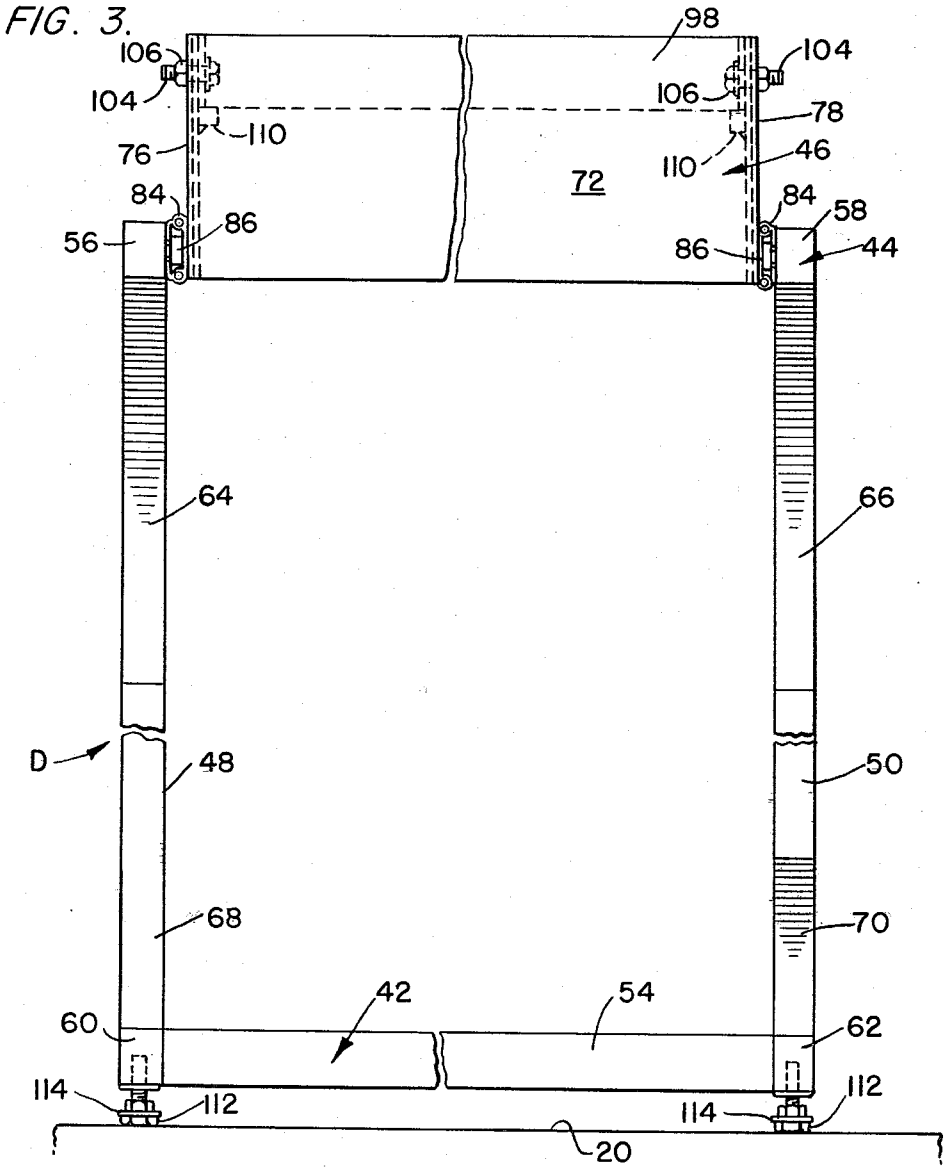
FIG. 3 is a front elevation of a rack assembly positioned at various discharge locations along the system of conveyance.

The console 12 is formed by a housing having a component 16 arranged vertically and a component 18 arranged horizontally, reference being to a surface 20 (see FIGS. 3 and 4). As illustrated in FIG. 1, approximately one-half of the slots may be located in each housing component. In this manner, the uppermost slot 14 in the housing component 16, likewise will be in easy reach of the individuals at the working zone.

The slots 14, $14_1$, $14_2$, and so forth in the housing component 16 each communicate with a chute (not shown) of the outline of the region between opposed sides of the console and individual pairs of walls 22 extending from the slot. Each chute connects a slot to a position between respective pairs of spaced walls 24 within the lower portion of console 12. The walls are located in vertical disposition and pairs of walls in the housing component 18 comprise the individual chutes. The chutes are rectangular or substantially rectangular in cross-section and correspondence moves by gravity from a slot into which it is received, through a chute, to a system of conveyance for movement of individual pieces of correspondence between an upstream location, at console 12, and selected downstream locations.

The system of conveyance and routing of sorted correspondence is generally denoted by the numeral "26". The system includes a plurality of conveying paths 28, equal in number to the number of slots 14, $14_1$, . . . $14_n$. Each conveying path is formed by a pair of walls 30 and a belt 32 of an individual conveyor. The walls 30 are arranged in vertical orientation, at a spacing equal to the spacing of walls 24, and located in end-to-end relation with the latter walls so that the correspondence entering a slot, and which will fall by gravity through a chute, may move in the downstream direction along a respective conveyor path.

Both the console 12 and the structure of the conveying system 26 are supported by a framework (not shown) as may be conventional. The framework, in turn, provides support for individual pulley or guide wheels, their supporting shafts, drive means for driving a shaft of each pair of pulleys and so forth (not shown, but conventional in the art) below the walls 30. Therefore, each belt 32 will locate the lower surface of a channel between walls 30 which comprise the conveying paths.

FIG. 1 illustrates a plurality of conveying paths extending in one direction from table 10. A second plurality of conveying paths may extend in an opposite direction or in a direction normal to the first direction, and there may be provision of a plurality of slot entries to communicate with each channel of each plurality of conveying paths.

A photoelectric system 34 or the equivalent may be located in each console 12 to provide a readout of the number of pieces of correspondence both sorted and routed. To this end, a source may provide a light beam along an axis normal to the direction of movement of correspondence along a conveying path. The light source may be supported by a wall 24, comprising the outer wall of the console 12, and a photosensitive device will be supported by the opposite outer wall. If each wall located therebetween is provided with an opening through which the light beam may pass, correspondence moving along a conveying path will interrupt the beam of light. Each interruption will be recorded.

Discharge locations, such as locations 36, $36_1$, $36_2$, . . . $36_n$ are provided along the conveying system from the upstream console 12. These discharge locations are on one side of the apparatus and similar locations 38, $38_1$, $38_2$, . . . $38_n$ may be found along the other side of the apparatus. A rack assembly, for collection of correspondence, is disposed at each discharge location.

The rack assembly 40 may be seen perhaps to best advantage in FIGS. 3 and 4. The rack assembly is also illustrated in FIG. 1, in phantom; and in FIGS. 5, 6 and 7 which, additionally, illustrate various collection devices for collection of the sorted and routed correspondence as mounted by a hanger assembly.

The rack assembly 40 is in the form of a weldment having a base 42, an upper support 44 mounting the hanger assembly 46 and a pair of posts or stanchions 48, 50 which mount the upper support over the base. The upper support and the base both include a plurality of members, and each respective member of the upper support is substantially coextensive in length and similarly oriented to a member of the base. Particularly, the upper support 44 (and the base 42) includes a rear member 52 (54) and a pair of arms 56, 58 (60, 62) extending from the rear member in spaced, parallel relation. A pair of elements 64, 66 extend between the stanchions and the arms of the upper support, and a further pair of elements 68, 70 extend between the stanchions and the arms of the base. The elements impart a measure of structural rigidity and serve to increase the strength of the rack assembly. As may be apparent, material selection for the rack assembly and other structure of the apparatus heretofore mentioned and hereafter to be mentioned will be with a view to these requirements.

The various members, arms and elements of the rack assembly may be connected in any conventional manner, and each, for example, may be formed of rectangular tubular material.

The hanger assembly 46 generally is in the form of a rectangular frame, opened at both the top and bottom. As may be seen in the Figures, the frame includes front and rear plates 72, 74 and side plates 76, 78 respectively. The plates may be attached together in any manner as may be conventional. The opposed pairs of plates are similar in overall outline, and of the same height, although the front and rear plates are longer. Further, the side plates each include a cutout 80 located along the upper surface. The cutouts are coextensive, of rectangular outline and centrally located in each side plate.

The hanger assembly 46 is mounted to the upper support 44 thereby to be movable as indicated by arrow 82, relative to the upper support as a drawer is movable in a desk. To this end, a guide 84 is carried along each of the arms 56, 58 and a roller assembly 86 having upper and lower rollers received in upper and lower tracks of the guide is mounted on each side of the hanger assembly, along the lower surface of side plates 76, 78.

Figure 5:
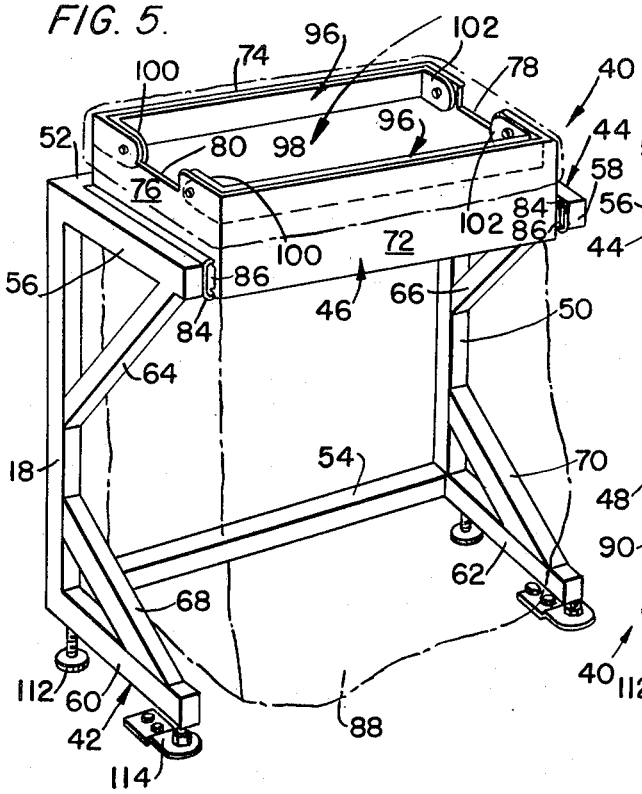
FIGS. 5, 6 and 7 are perspective views of the rack assembly of FIGS. 3 and 4, illustrating the manner of support of a single bag, a pair of bags and a tote box, respectively, on a hanger assembly.
Figure 6:
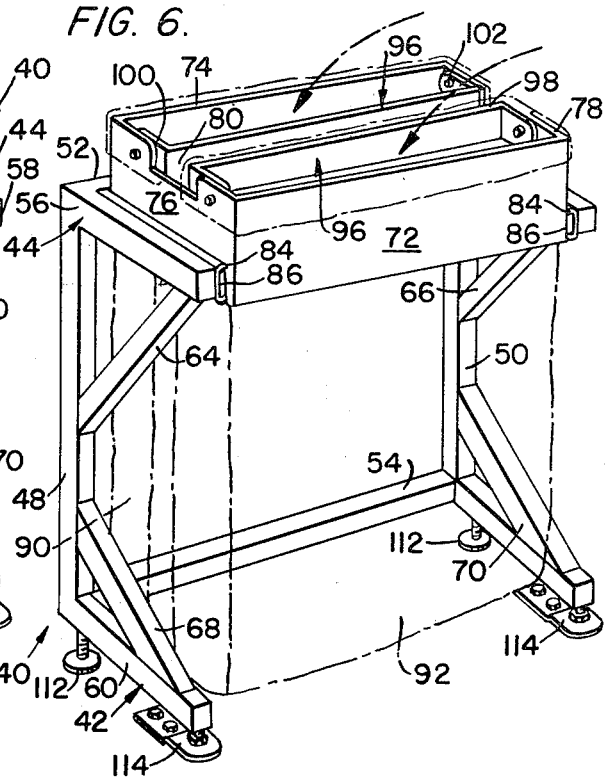
Figure 7:
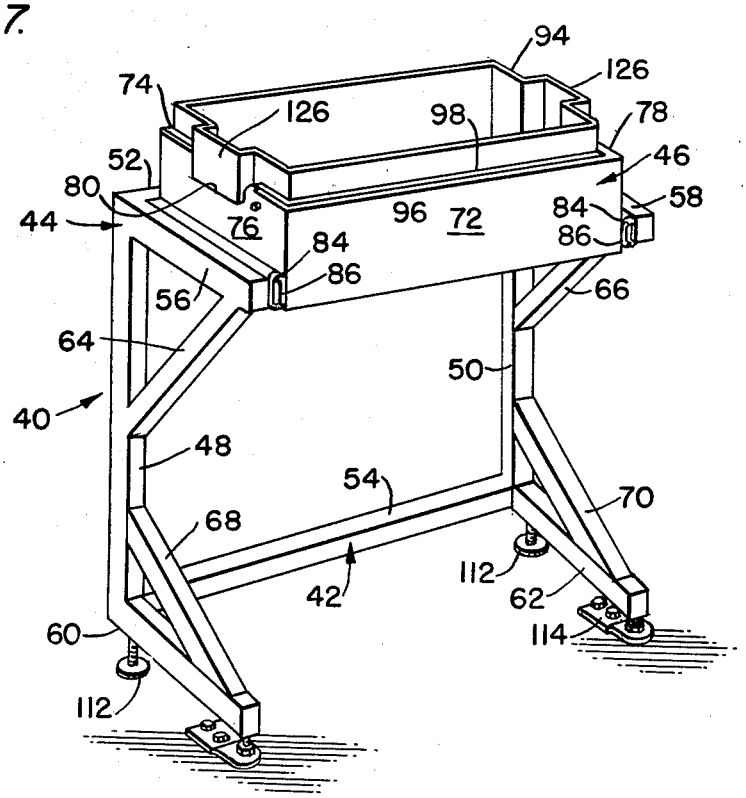

An important aspect of the invention resides in the capability of the rack assembly 46 to support any of a plurality of collection devices. Referring to FIGS. 5, 6 and 7, there is illustrated a bag 88, a pair of bags 90, 92 and a tote box 94, respectively. This aspect of the invention particularly relates to the convertibility of the rack assembly from one manner of use to another.

A hanger 96, and preferably a pair of hangers are mounted by the frame of hanger assembly 46. Each hanger, see FIGS. 5 and 6, is of U-shaped outline including a base 98 and a pair of arms 100, 102. The hangers are mounted for movement between a pair of positions including a retracted, non-operative position (FIGS. 5 and 7) and an operative position (FIG. 6). To this end, each arm 100, 102 is pivotally mounted to a respective side plate 76, 78 between the end of the plate and the cutout 80. Typically, the mounting may include a bolt 104 received through apertures both in the arm and side plate with which it is in juxtaposition, a lock nut and washer (not shown) supported by the head of the bolt internally both of the frame, and arm, and a nut 106 threaded on the bolt. The aperture 108 in the arms preferably will be elongated thereby to permit adjustment of the hanger toward and away from a front or rear wall in either position. Pivotal movement of the hanger is through approximately a 180° path, limited at each extreme by a stop 110. The stop also serves to support the hanger or hangers when moved to the operative position.

The rack assembly 40 may be mounted permanently to surface 20, which may be the floor, or the rack assembly may merely reside in movable relation on the floor. In either case, the rack assembly is supported by a plurality of feet 112, each having well-known leveling capability. A pair of brackets 114, may be associated with each of the front feet and a pair of gussets 116 may be associated with the rear feet in the event of permanent mounting of the rack assembly to the floor. Permanent mounting may be completed by bolting each of the brackets and gussets to the floor, as at 118.

As illustrated in FIG. 4, the brackets are received around a threaded bolt comprising a portion of the front feet and the gussets are bolted to the rear member 52. A plate portion 120 of each gusset 116 includes an elongated slot to permit adjustment of the rear leveling foot and the rack assembly.

Figure 2:
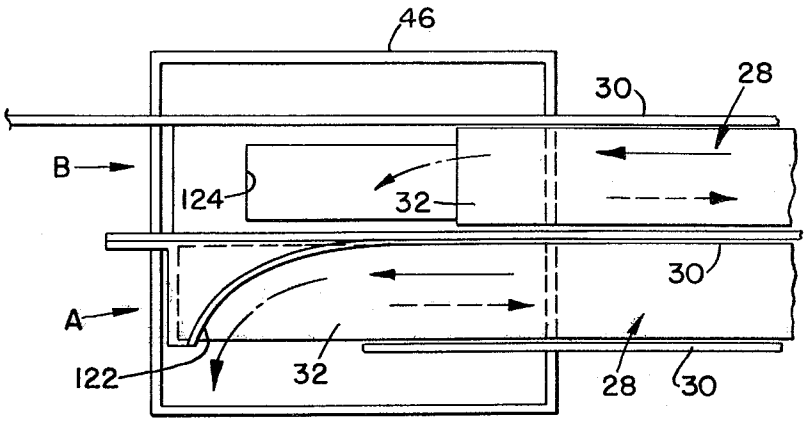
FIG. 2 is a fragmentary plan view of a portion of the system of conveyance.

In operation, correspondence, following sorting, is located to a respective slot 14 in console 12. A listing (not shown) may be located on the console to identify a slot with a particular discharge location. The correspondence falls in a chute by gravity to one of the conveying paths 28 of the system for conveyance. Referring to FIG. 2, there is illustrated a pair of conveying paths, identified as path A and B, each formed by a pair of walls 30 and a belt 32 whose upper track defines the lower surface of the channel. The upper track also supports the correspondence in movement downstream in the direction of the solid arrow. The lower track (not shown in FIG. 2) is represented by the dashed arrow.

As the correspondence moves downstream, it approaches the designated discharge location. According to one form of the invention, adjacent conveyor paths, such as those illustrated in FIG. 2, may route correspondence to a pair of discharge locations for collection of the correspondence by one or a pair of collection devices supported by a single rack assembly 40. As illustrated in FIG. 2, correspondence moves with belt 32 along conveyor path A to a position at which a wall 122 diverts it from the path, the correspondence then falling into a collection device which may be a bag 88, bag 92 or tote box 94. Corrrespondence moving with belt 32 along conveyor path B likewise falls into a collection device which may be bag 88, or tote box 94, or bag 90. To this end, the belt 32 in conveyor path B has a run shorter than the run of belt 32 in conveyor path A. Actually, the belt in conveyor path B terminates at an opening 124 in the frame structure above the collection device.

As discussed, a single bag 88 may be supported by the hanger assembly. A pair of bags 90, 92, or one of them, may be supported by the hanger assembly in substantially similar manner. To this end, the region of the opening of the bag is folded either about the frame of the hanger assembly or about a portion of the frame and one or the other of the hangers 96 to extend through the open bottom. Additionally, the tote box 94 may be supported by the frame of the hanger assembly in substitution for any one of bags 88, 90 and 92. The tote box is of a size to be received within the frame with the hangers in the retracted, non-operative position. A pair of shoulders 126 are formed on opposite sides of the box and as seen in FIG. 9, the shoulders interact with cutouts 80 to locate the tote box relative to the frame of hanger assembly 46. When the respective collection device(s) at any discharge location is to be replaced, the hanger assembly is merely relocated on its track away from the rear member 52 of the upper support 44 of rack assembly 40. This movement positions the frame of hanger assembly 46 so that the manipulation in locating and removing the collection device, as discussed, may be carried out easily.

We claim:

1. In combination with routing apparatus for correspondence having a housing and plurality of slots for entry of said correspondence to a selected conveyor path and movement from said housing to a discharge location along each path, a rack assembly for collection of correspondence at a discharge location of each of two adjacent conveyor paths, said rack assembly comprising a hanger assembly including a frame having a plurality of members arranged in a rectangular pattern, each said member formed by a substantially rectangular plate connected to an adjacent plate along respective sides of minor dimension, a collection device for said correspondence supported by said hanger assembly, said collection device having an opening located to receive correspondence from either or both of said adjacent conveyor paths, and means for supporting said hanger assembly below said discharge location of each said conveyor path.

2. The combination of claim 1 including at least one hanger member having a base and a pair of arms, one arm of said hanger supported by one frame member and the other arm of said hanger supported by another frame member of an opposed pair so that said base of said hanger extends between said pair of frame members, means mounting said hanger for movement pivotally from a first to a second position, stop means for locating said hanger in each position, and wherein said collection device is selected from the group consisting of a box and a bag.

3. The combination of claim 2 including a second hanger member, each hanger movable from said first position wherein each base is juxtaposed to an adjacent frame member of the other opposed pair of frame members to said second position wherein said bases of said hangers are juxtaposed to one another, and wherein said hanger assembly is adapted to support one of a bag and a box when said hangers are in said first position, and said hanger assembly and each hanger is adapted to mount a bag when said hangers are in said second position.

4. A rack assembly for use with conveying apparatus for collection of articles conveyed, said rack assembly comprising a hanger assembly including a frame having a plurality of members arranged in a rectangular pattern, each said member formed by a substantially rectangular plate connected to an adjacent plate along respective sides of minor dimension, at least one hanger member having a base and a pair of arms, one arm of said hanger supported by one frame member and the other arm of said hanger supported by another frame member of an opposed pair so that said base of said hanger extends between said opposed frame members, means mounting said hanger for movement pivotally from a first to a second position, stop means for locating said hanger in each position, a collection device for said articles supported by said hanger assembly, and means for supporting said hanger assembly relative to said conveying apparatus.

5. The rack assembly of claim 4 including a second hanger member, each hanger movable from said first position wherein each base is juxtaposed to an adjacent frame member of the other opposed pair of frame members to said second position wherein said bases of said hangers are juxtaposed to one another, and wherein said collection device supported by said angle assembly is selected from the group consisting of a box and a bag.

6. The rack assembly of claim 5 wherein said collection device includes a box, a pair of shoulders on opposite sides of said box, and a pair of cutouts formed in said plate members of one opposed pair, said shoulders being substantially coextensive in size to said cutouts for supported receipt of said box within said frame.

7. The rack assembly of claim 6 wherein said cutouts in said frame members are located on said opposed pair of frame members.

8. The rack assembly of claim 5 wherein said collection device includes at least one bag, said bag being supported at least partially by said frame.

9. The rack assembly of claim 5 wherein said collection device includes two bags, each said hanger located in said second position, and each said bag supported partially by said hanger and partially by said hanger assembly.

10. The rack assembly of any one of claims 4–9 wherein said supporting means includes an upper support, guide means carried by said upper support and a roller assembly carried by said hanger assembly whereby said hanger assembly may be moved relative to said supporting means.

* * * * *